US007167138B2

(12) United States Patent
Eom et al.

(10) Patent No.: US 7,167,138 B2
(45) Date of Patent: Jan. 23, 2007

(54) TRIPLE-BAND OFFSET HYBRID ANTENNA USING SHAPED REFLECTOR

(75) Inventors: Soon-Young Eom, Daejon (KR); Young-Bae Jung, Daejon (KR); Jae-Seung Yun, Daejon (KR); Seong-Ho Son, Busan (KR); Soon-Ik Jeon, Daejon (KR)

(73) Assignee: Electronics and Telecommunications Research Institute (KR)

( * ) Notice: Subject to any disclaimer, the term of this patent is extended or adjusted under 35 U.S.C. 154(b) by 0 days.

(21) Appl. No.: 11/003,883

(22) Filed: Dec. 2, 2004

(65) Prior Publication Data

US 2005/0140563 A1 Jun. 30, 2005

(30) Foreign Application Priority Data

Dec. 27, 2003 (KR) ..... 10-2003-0098283

(51) Int. Cl.
*H01Q 19/17* (2006.01)

(52) U.S. Cl. ..... 343/781 R; 343/779; 343/835

(58) Field of Classification Search ..... 343/781 P, 343/840, 700 MS, 853, 779, 781 R, 835
See application file for complete search history.

(56) References Cited

U.S. PATENT DOCUMENTS 5,202,700 A 4/1993 Miller
6,392,611 B1 5/2002 Smith et al.
2005/0052333 A1* 3/2005 Rao et al. ..... 343/840

FOREIGN PATENT DOCUMENTS

JP 2001-007637 1/2001
JP 2002-124818 4/2002

OTHER PUBLICATIONS

Wide-Angle Scanning with Reflector Antennas: A New Design Technique, pp. 136-144, Oct. 2000.

* cited by examiner

*Primary Examiner*—Michael C. Wimer
(74) *Attorney, Agent, or Firm*—Blakely Sokoloff Taylor & Zafman

(57) ABSTRACT

A triple-band offset hybrid antenna having a shaped reflector is disclosed. The triple-band offset hybrid antenna includes: a shaped reflector reflecting a K/Ku bands RF signals received from a satellite to focus an energy of the K/Ku band RF signals on a focal line and reflecting a Ka band RF transmitting signal; and a triple-band active phased feed array receiving the reflected K/Ku bands RF signals from the shaped reflector and radiating the Ka band RF transmitting signal to the shaped reflector, wherein the triple-active feed array including Ka/K bands feed array for transceiving Ka/K bands RF signal and a Ku band feed array for receiving a Ku band RF signal.

7 Claims, 23 Drawing Sheets

TRIPLE-BAND OFFSET HYBRID ANTENNA USING SHAPED REFLECTOR

FIELD OF THE INVENTION

The present invention relates to an offset hybrid antenna; and, more particularly, to a triple-band offset hybrid antenna using a shaped reflector for a satellite communication.

DESCRIPTION OF RELATED ARTS

Generally, an antenna structure is designed by considering various factors of the antenna such as a performance, a price and an implementation environment.

A conventional phased array antenna system having an electronic tracking system can track a target in high speed by using an electronic beam and thus, the conventional phased array antenna system has been widely used for a military ladder system that requires a high speed and an accurate tracking.

If the phased array antenna system must have characteristics of a multi-band, a high gain and a wide beam scan sector, there are many limitations in views of manufacturing, price and integration for satisfying the above mentioned requirements in order to manufacturing the phased array antenna system.

A conventional antenna having a mechanical positioning device can be manufactured in a low cost and has simple antenna structure. However, the conventional antenna having the mechanical positioning device has a slower tracking speed comparing to the conventional phased array antenna system having the electronic tracking system and also, may generate a tracking error. Therefore, a tracking performance of the conventional antenna having the mechanical positioning device is comparatively lower comparing to the conventional phased array antenna system.

For overcoming disadvantages of above mentioned conventional antennas, a conventional hybrid antenna has been introduced. The hybrid antenna has advantages of both of the above mentioned conventional antenna systems which are the conventional mechanical antenna having the mechanical positioning device and the conventional phased array antenna having the electronic beam scanning. That is, the conventional hybrid antenna is accessible to an antenna system that coarsely tracks a target by the mechanical positioning and then finely tracks the target by the electronic beam scanning.

There are various types of the conventional hybrid antennas such as a hybrid antenna having a parabola reflector with a feed horn, a hybrid antenna having parabola cylinder type reflector with a linear feed array and a hybrid antenna having a linear feed switching array.

However, a hybrid antenna requires abrupt variations of amplitude and phase distributions according to a scanning angle. Therefore, implementation of a hybrid antenna having a desired scanning angle is very complicated.

SUMMARY OF THE INVENTION

It is, therefore, an object of the present invention to provide a triple-band offset hybrid antenna having a shaped reflector for reducing a blocking loss and optimizing a beam pattern by shaping an aperture of a reflector for optimizing one-dimensional beam scanning and by offsetting a feed array.

It is another object of the present invention to provide a triple-band offset hybrid antenna using a shaped reflector for operating in K/Ka/Ku bands served from one geo-stationary satellite.

It is another object of the present invention to provide a triple-band offset hybrid antenna with relatively high efficiency by removing non-efficient edge areas of a shaped reflector.

In accordance with an aspect of the present invention, there is provided a triple-band offset hybrid antenna, including: a shaped reflector reflecting a K/Ku bands RF signals received from a satellite to focus an energy of the K/Ku bands RF signals on a focal line and reflecting a Ka band RF transmitting signal; and a triple-band active phased feed array receiving the reflected K/Ku bands RF signals from the shaped reflector and radiating the Ka band RF transmitting signal to the shaped reflector, wherein the triple-active feed array including Ka/K bands feed array for transceiving Ka/K bands RF signal and a Ku band feed array for receiving a Ku band RF signal.

A triple-band offset hybrid antenna using a focuser of the present invention can be mounted on the moving object such as vehicles, ships and so on for transceiving a multimedia data from/to a satellite and uses K band for receiving, Ka band for transmitting and Ku band for direct broadcasting service (DBS). Also, a feed array is independently implemented into two parts. One part is the feeder array for dual Ka/K bands and the other for Ku band.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a triple-band offset hybrid antenna using a shaped reflector for a satellite communication in accordance with a preferred embodiment of the present invention will be described in detail with reference to the accompanying drawings.

Figure 1A:
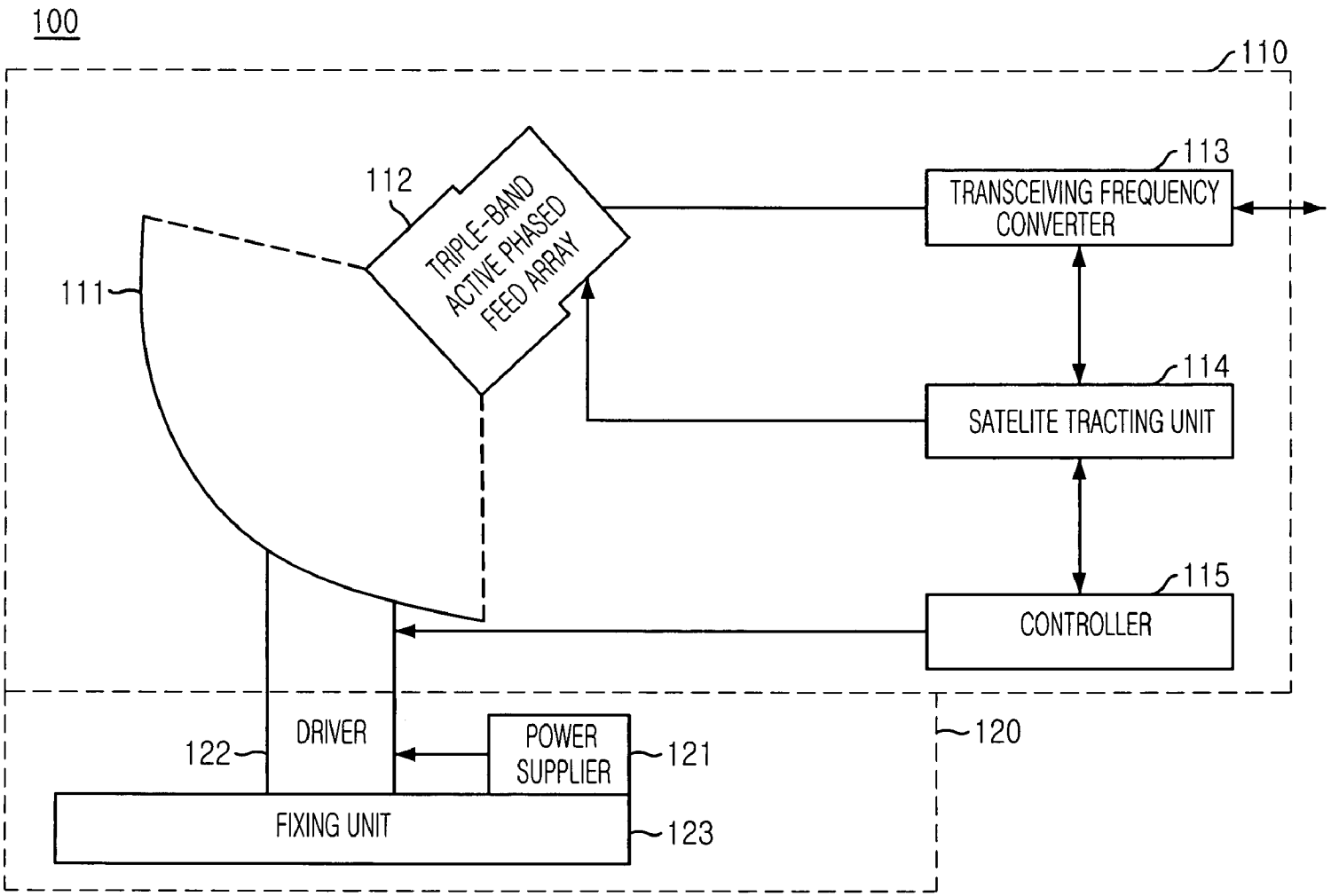
FIG. 1A is a diagram illustrating a triple-band hybrid antenna in accordance with a first embodiment of the present invention.
Figure 1B:
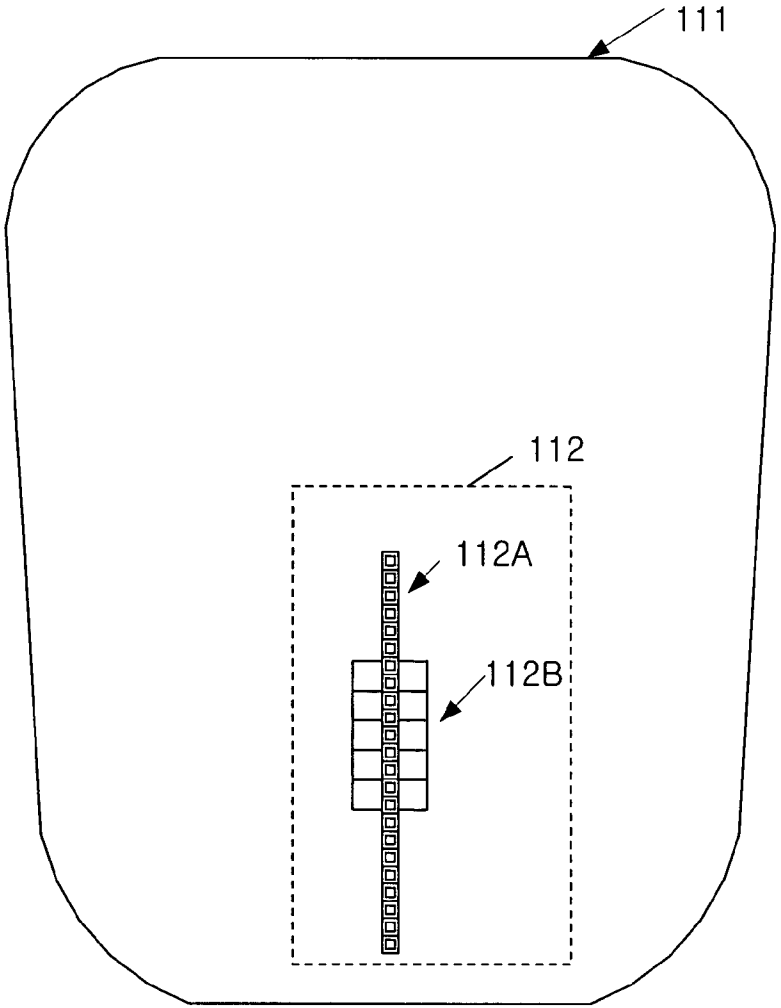
FIG. 1B is a top view of a triple-band offset hybrid antenna having a shaped reflector in accordance with the first embodiment of the present invention.

FIGS. 1A and 1B is a diagram illustrating a triple-band hybrid antenna in accordance with a first embodiment of the present invention.

As shown, the triple-band offset hybrid antenna 100 includes a rotating unit 110 and a fixing unit 120.

The fixing unit 120 includes a power supplier 121, a motor driving unit 122 and a mount 123. The fixing unit 120 is a mounting structure for supporting the rotating unit 110 of the triple-band offset hybrid antenna 100.

The rotating unit 110 includes a shaped reflector 111, a triple-band active phased feed array 112, a transceiving frequency converter 113, a satellite tracking unit 114 and a controller 115. The triple-band active, phased feed array 112 is offset from axis of the shaped reflector 111 for reducing a blocking loss and for obtaining lower sidelobe level. That is, the triple-band active phased feed array 113 is separately implemented from the shaped reflector 111.

The power supplier 121 provides direct current (DC) powers to the triple-band active phased feed array 112, the transceiving frequency converter 113, the satellite tracking unit 114 and the controller 115.

The motor driving unit 122 includes a rotary joint (not shown) providing a path of a transceiving intermediate (IF) signal and DC powers to the rotating unit 110.

The triple-band offset hybrid antenna 100 using the shaped reflector 111 receives and transmits K/Ka/Ku bands RF signals by using the triple-band active phased feed array 112.

The shaped reflector 111 is shaped for one-dimensional beam scanning in elevation. The shaped reflector 111 makes a plane-wave energy coming from given incidence angle be concentrated on a focal line. The shaped reflector 111 may be also called as a focuser.

When the shaped reflector 111 receives a K/Ku bands RF signal from a satellite, the shaped reflector 11 reflects the K/Ku bands RF signal to the triple-band active phased feed array 112. The triple-band active phased feed array 112 amplifies the K/Ka/Ku bands RF signal and passes the amplified K/Ka/Ku bands RF signal to the transceiving frequency converter 113. The transceiving frequency converter 113 converts the amplified K band RF signal into an intermediate frequency signal. The intermediate frequency signal is passed to a receiver (not shown) through the rotary joint (not shown) of the motor driving unit 122.

For Ka band RF signal being transmitted to the satellite, the transceiving frequency converter 113 receives the intermediate frequency signal from the transmitter (not shown) and it converts to Ka band RF signal. The triple-band active phased feed array 112 amplifies the input RF signal to be the signal with high output power and radiates the amplified Ka band RF signal to the shaped reflector 111 for transmitting to the satellite. The triple-band active phased feed array 112 steers electronic beams to a desired direction by controlling phases of K/Ka/Ku bands RF signals.

FIG. 1B is a top view of a triple-band offset hybrid antenna having a shaped reflector in accordance with a first embodiment of the present invention.

Referring to FIG. 1B, the triple-band active phased feed array 112 includes Ka/K bands feed array 112A for transceiving Ka/K bands RF signal and a Ku band feed array 112B for receiving a Ku band RF signal.

As shown in FIG. 1B, the triple-band active phased feed array 112 is arranged at a focal line where the signal reflected from the shaped reflector 111 is concentrated. The Ka/K bands active phased feed array 112A includes a plurality of dual band array elements which are linearly arranged on the focal line. In the first embodiment of the present invention in FIG. 1B, 23 Ka/K bands(dual band) feed array elements are linearly arranged on the focal line, and the element spacing between array elements is a 9.4 mm which corresponds to 0.96 $\lambda_0$ in Ka band ($f_0$=30.485 GHz) and 0.65$\lambda_0$ in K band ($f_0$=20.755 GHz), respectively.

The Ku band feed array 112B includes a plurality of Ku band feed array elements which are arranged at right and left sides of the Ka/K bands feed array 112A. In the preferred embodiment of the present invention in FIG. 1B, 5 Ku band feed array elements are linearly arranged at right side of the Ka/K bands feed array 112A and 5 other Ku band single feed array elements are linearly arranged at left side of the Ka/K band feed array 112A. The element spacing between Ku band array elements is 15 mm which is 0.59 $\lambda_0$ in Ku band ($f_0$=11.85 GHz). A desired beam direction to satellite for Ka/K bands signal can be easily found by comparing two signal levels received from Ku band feed array elements positioned at both sides of the Ka/K bands feed array 112A.

Figure 2A:
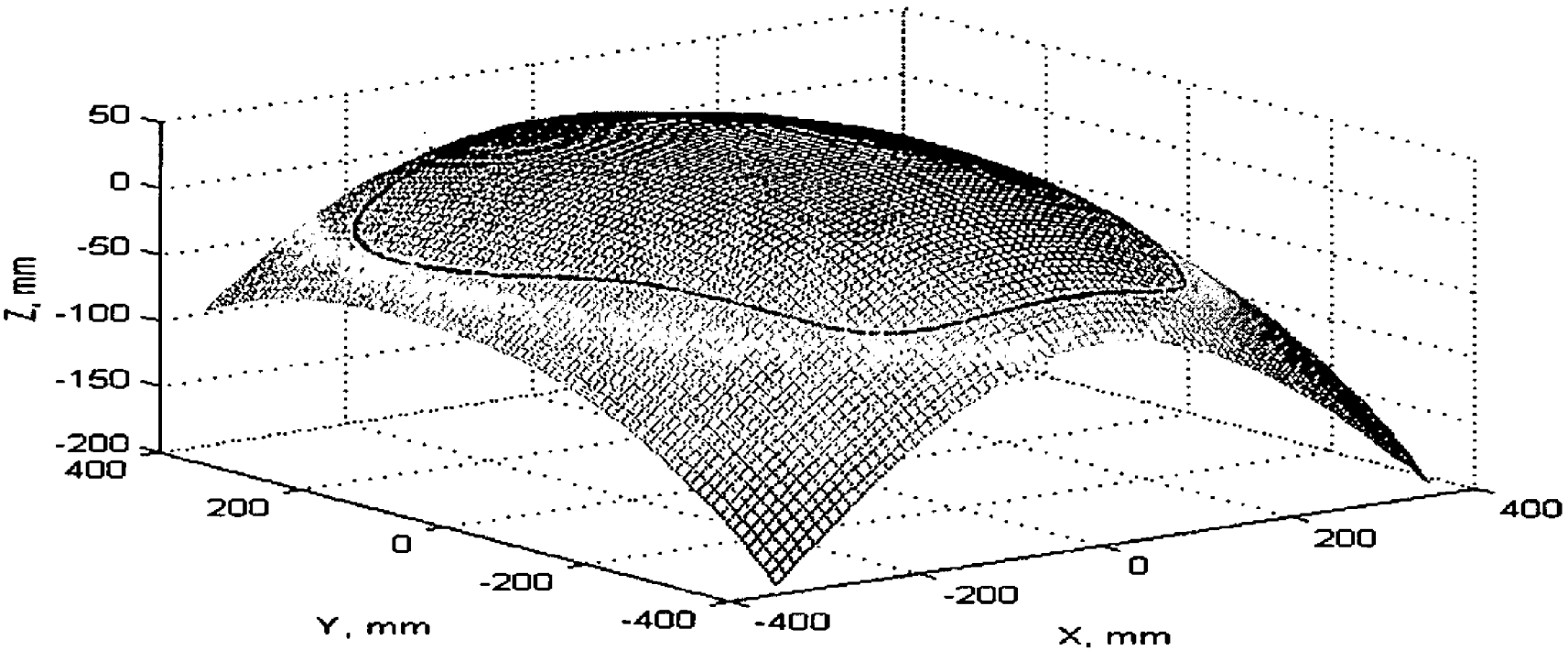
FIGS. 2A and 2B show a shaped reflector 111 in FIGS. 1A and 1B.
Figure 2B:
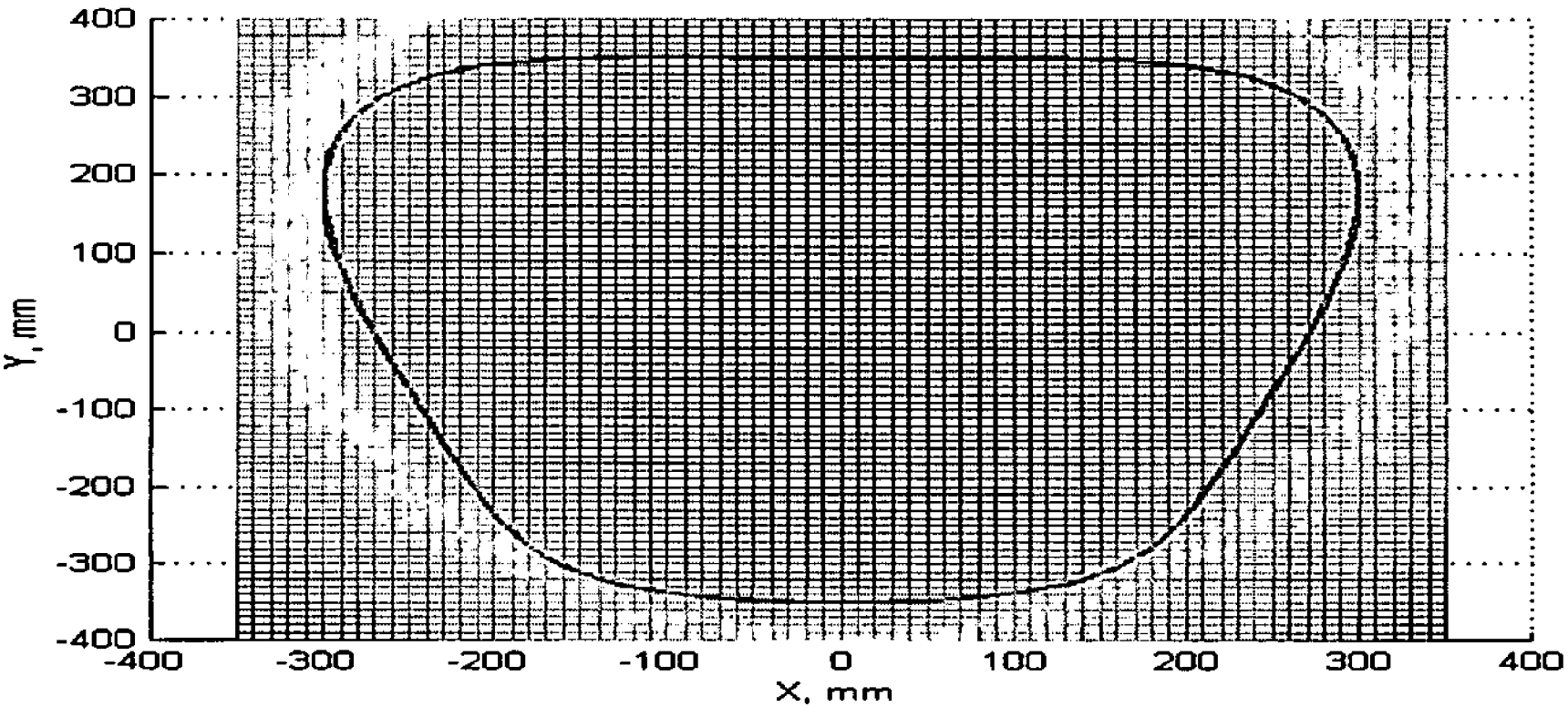

FIGS. 2A and 2B show a shaped reflector 111 in FIGS. 1A and 1B.

As shown in FIGS. 2A and 2B, edge of the shaped reflector 111 have the form of a curvilinear rim and non-efficient areas of edge are removed from the aperture of the shaped reflector for improving an antenna aperture efficiency. The surface of the reflector 111 is optimally chosen for linear beam scanning in elevation. That is, it is designed for concentrating energy of reflected signal on the focal line.

Figure 3A:
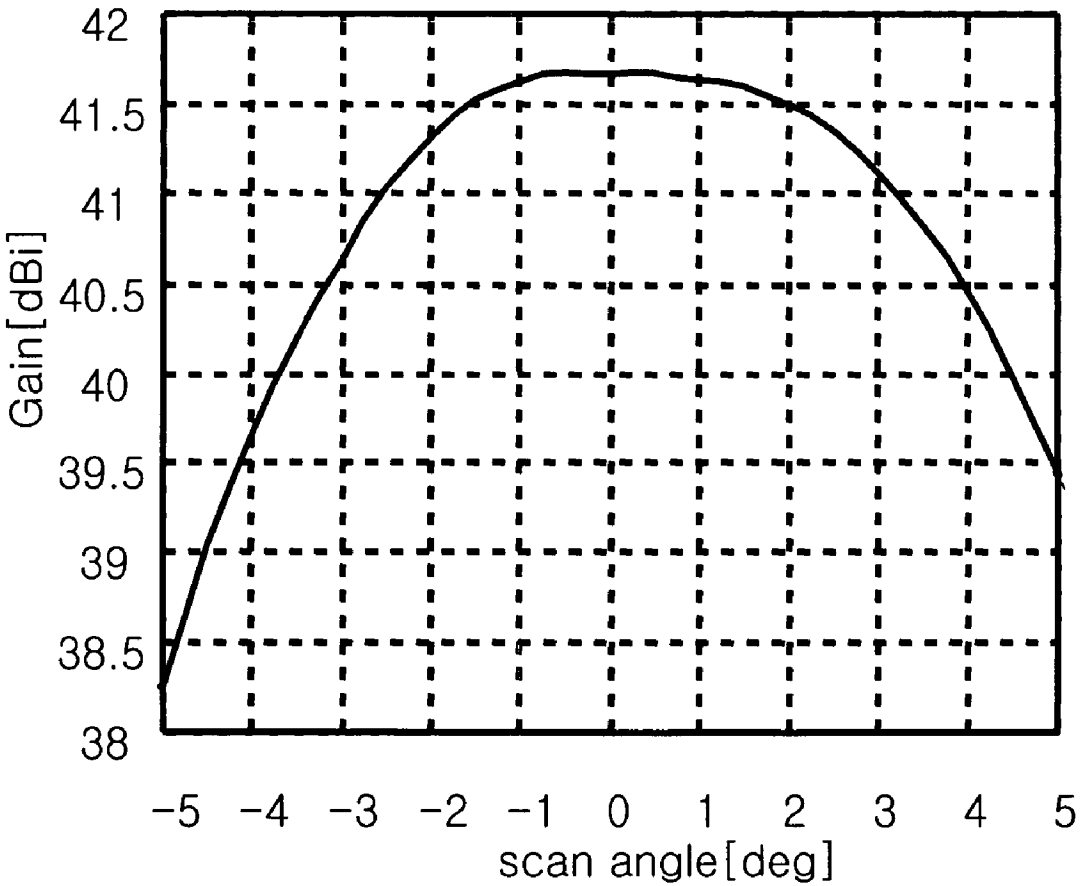
FIGS. 3A and 3B are graphs showing Ka/K bands beam scan gain characteristics of the triple-band offset hybrid antenna 100 of the first embodiment in FIGS. 1A and 1B.
Figure 3B:
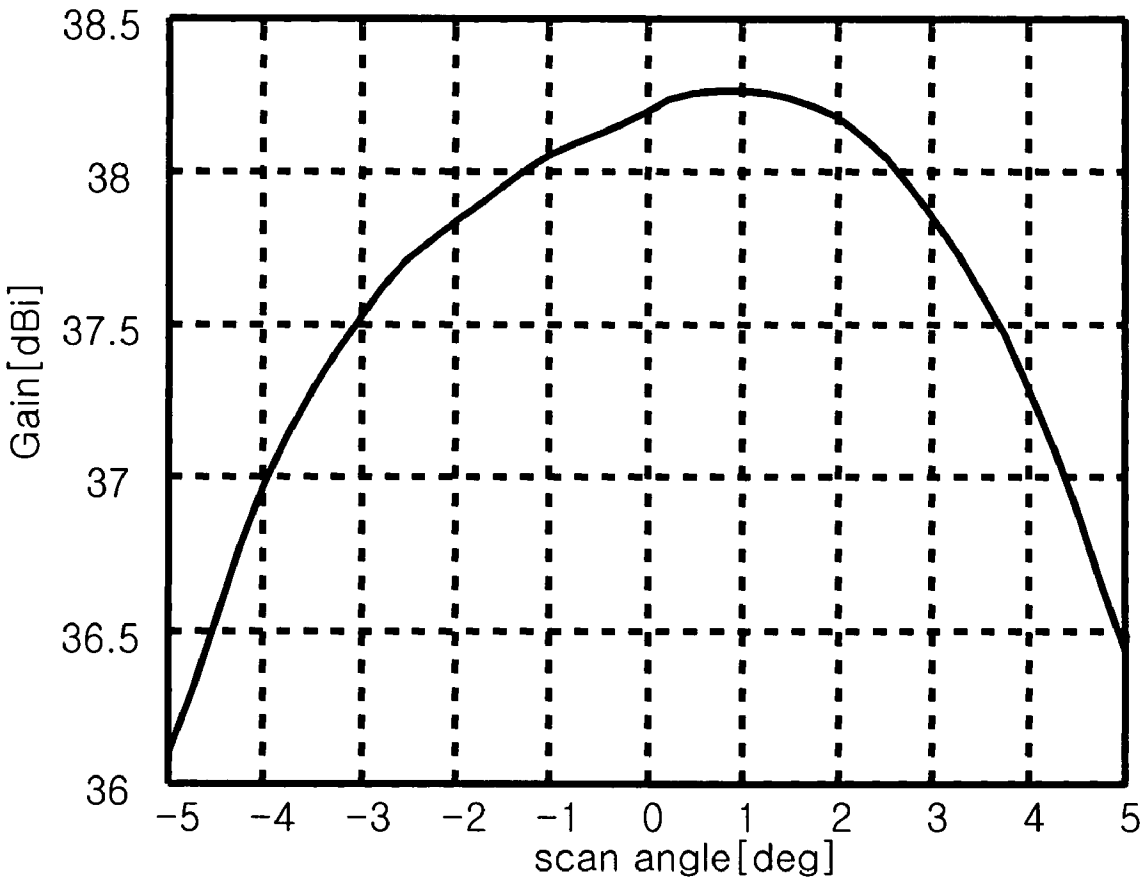
Figure 4A:
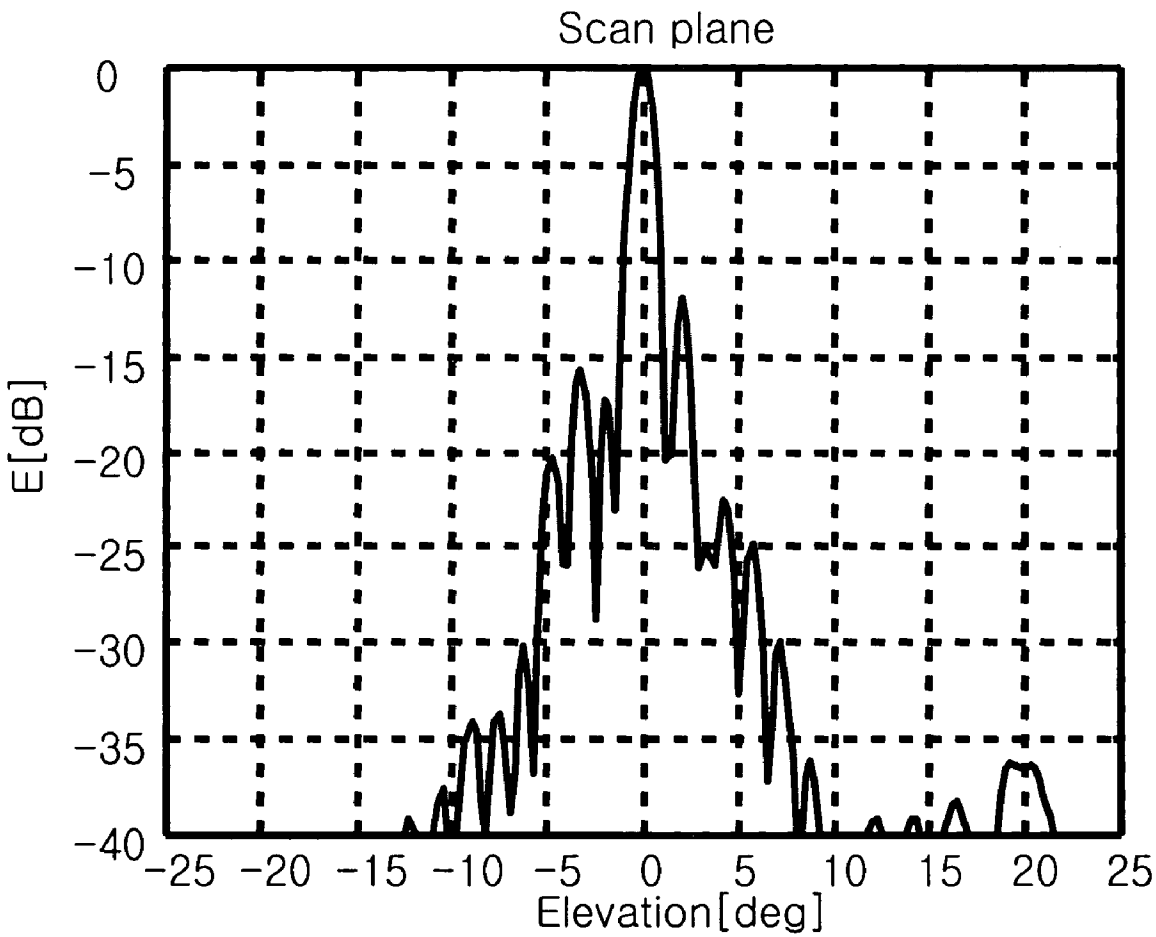
FIGS. 4A to 4D are graphs showing radiation patterns by beam scanning in Ka/K bands of a triple-band offset hybrid antenna with a shaped reflector in accordance with the first embodiment of the present invention.
Figure 4B:
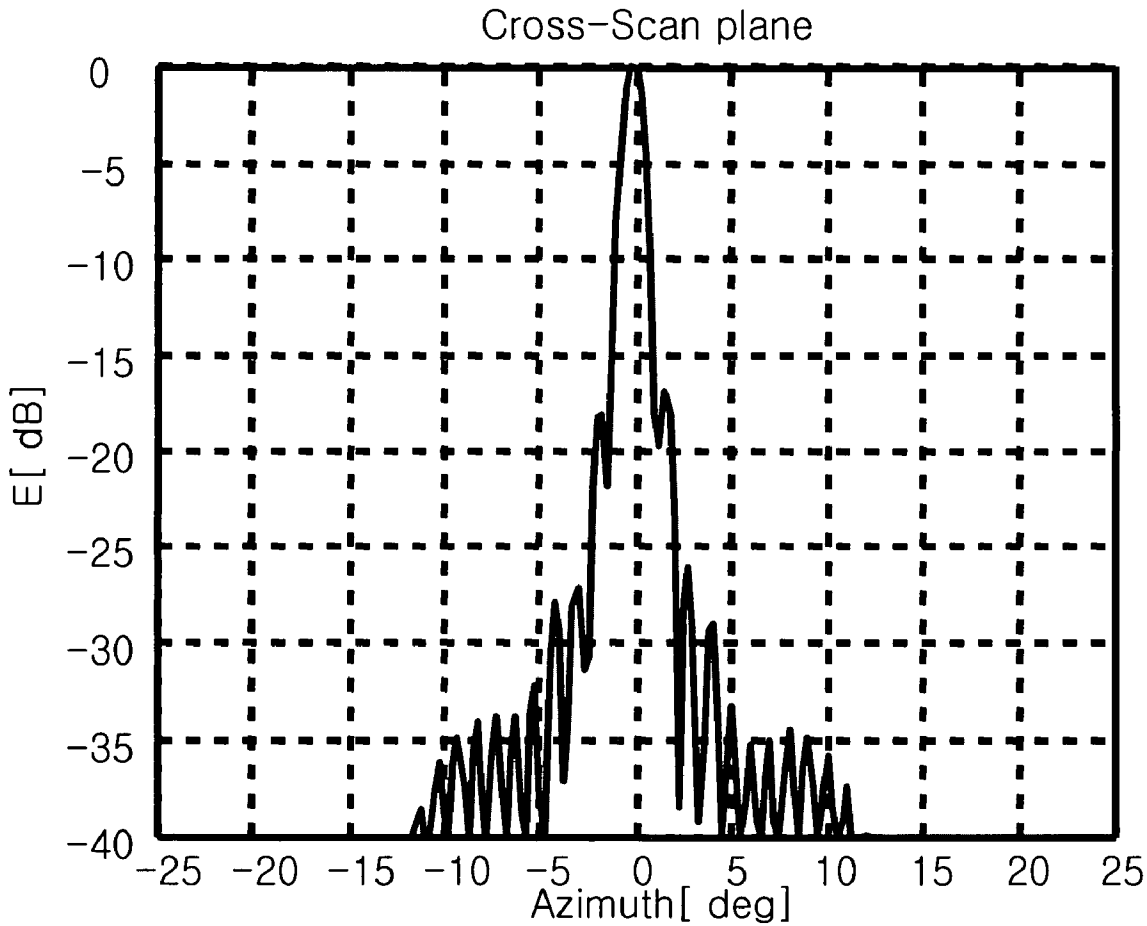
Figure 4C:
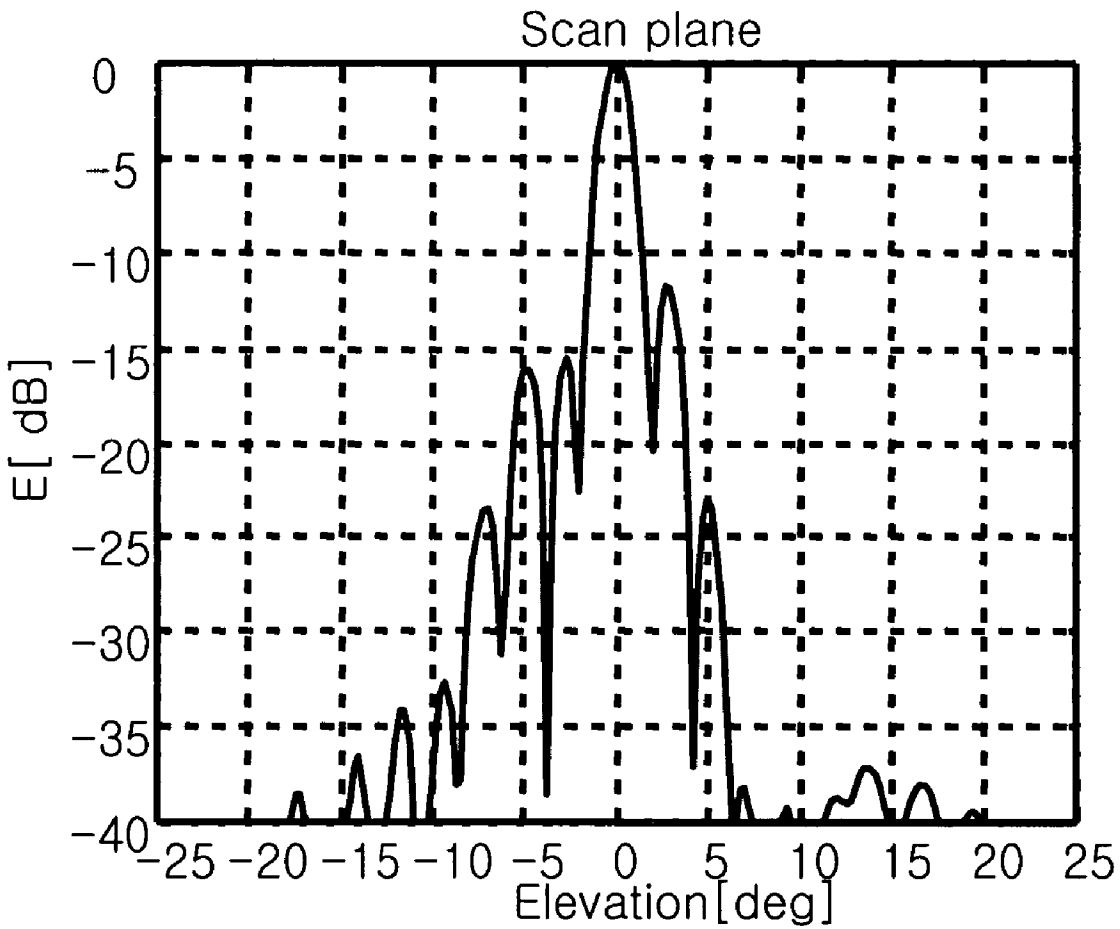
Figure 4D:
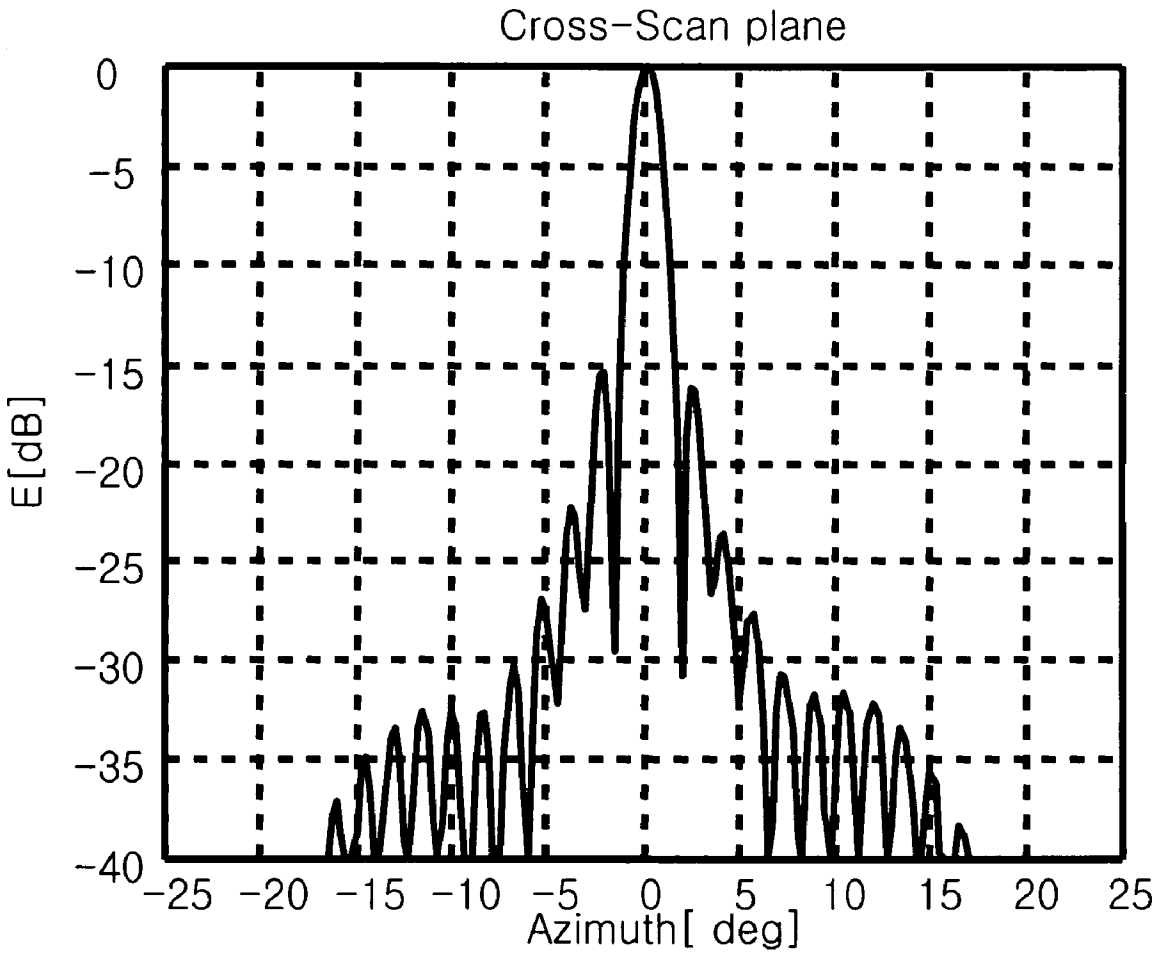

FIGS. 3A and 3B are graphs showing Ka/K bands beam scan gain characteristics of the triple-band offset hybrid antenna 100 of the first embodiment in FIGS. 1A and 1B.

As shown in FIG. 3A, the triple-band offset hybrid antenna 100 of the first embodiment provides the gain performance of minimum 40.7 dBi and maximum 41.7 dBi within ±3° of beam scanning range in Ka band.

AS shown in FIG. 3B, the triple-band offset hybrid antenna 100 of the first embodiment provides the gain performance of minimum 37.6 dBi and maximum 38.3 dBi in K band.

FIGS. 4A to 4D are graphs showing radiation patterns by beam scanning in Ka/K bands of a triple-band offset hybrid antenna with a shaped reflector in accordance with the first embodiment of the present invention.

Figure 5A:
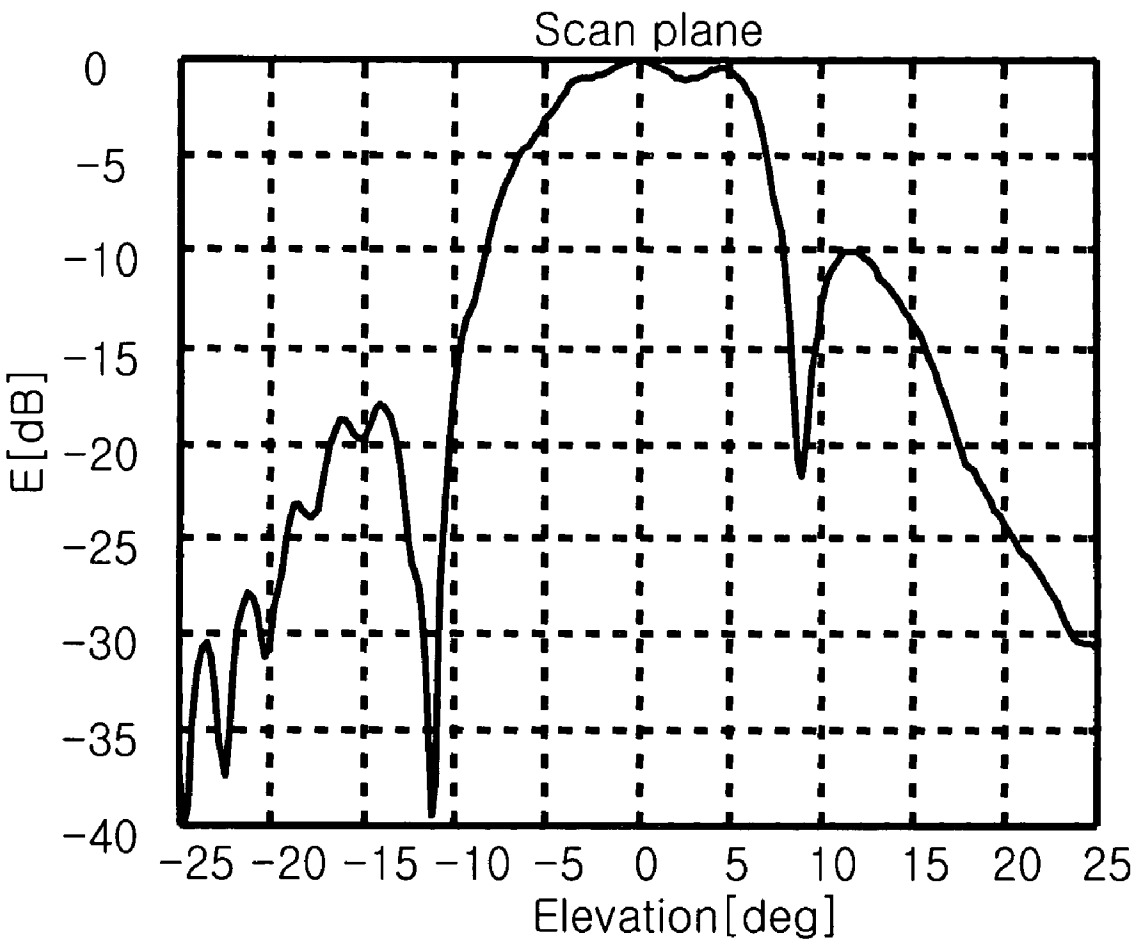
FIGS. 5A to 5B are graphs showing radiation patterns by beam scanning in Ku band of a triple-band offset hybrid antenna with a shaped reflector in accordance with the first embodiment of the present invention.
Figure 5B:
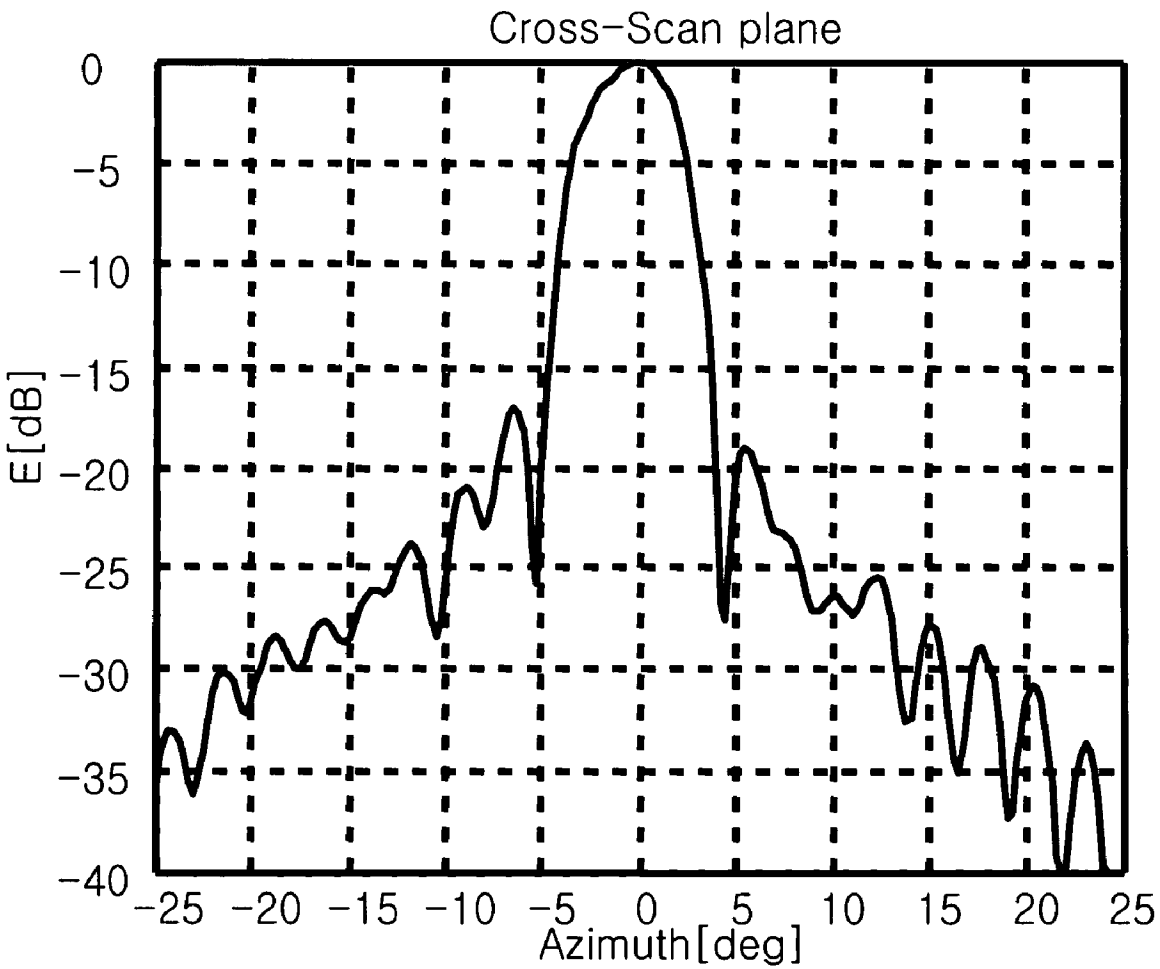

FIGS. 5A to 5B are graphs showing radiation patterns by beam scanning in Ku band of a triple-band offset hybrid antenna with a shaped reflector in accordance with the first embodiment of the present invention.

As shown in FIGS. 5A to 5B, the triple-band offset hybrid antenna 100 of the first embodiment provides gain performance of minimum 24.4 dBi in Ku band.

Figure 6:
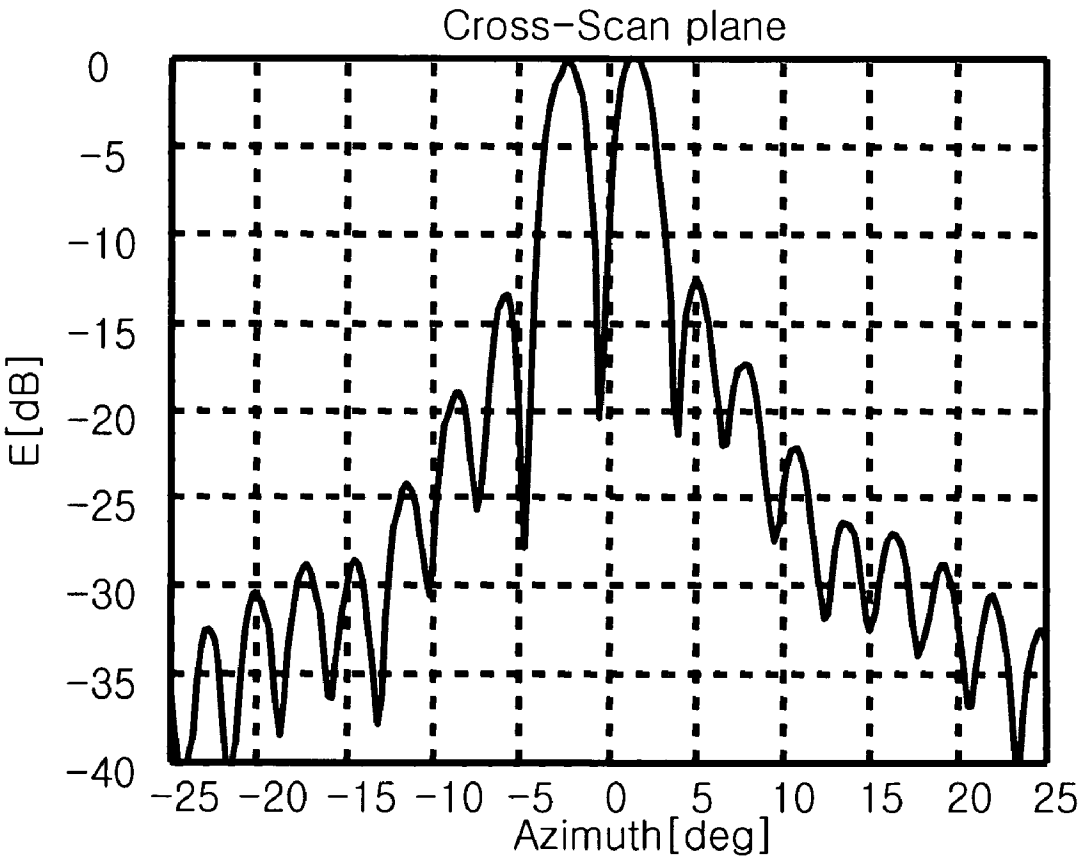
FIG. 6 is a graph showing difference pattern for tracking a satellite in Ku band in accordance with the first embodiment of the present invention.

FIG. 6 is a graph showing difference pattern for tracking a satellite in Ku band in accordance with the first embodiment of the present invention.

Figure 7:
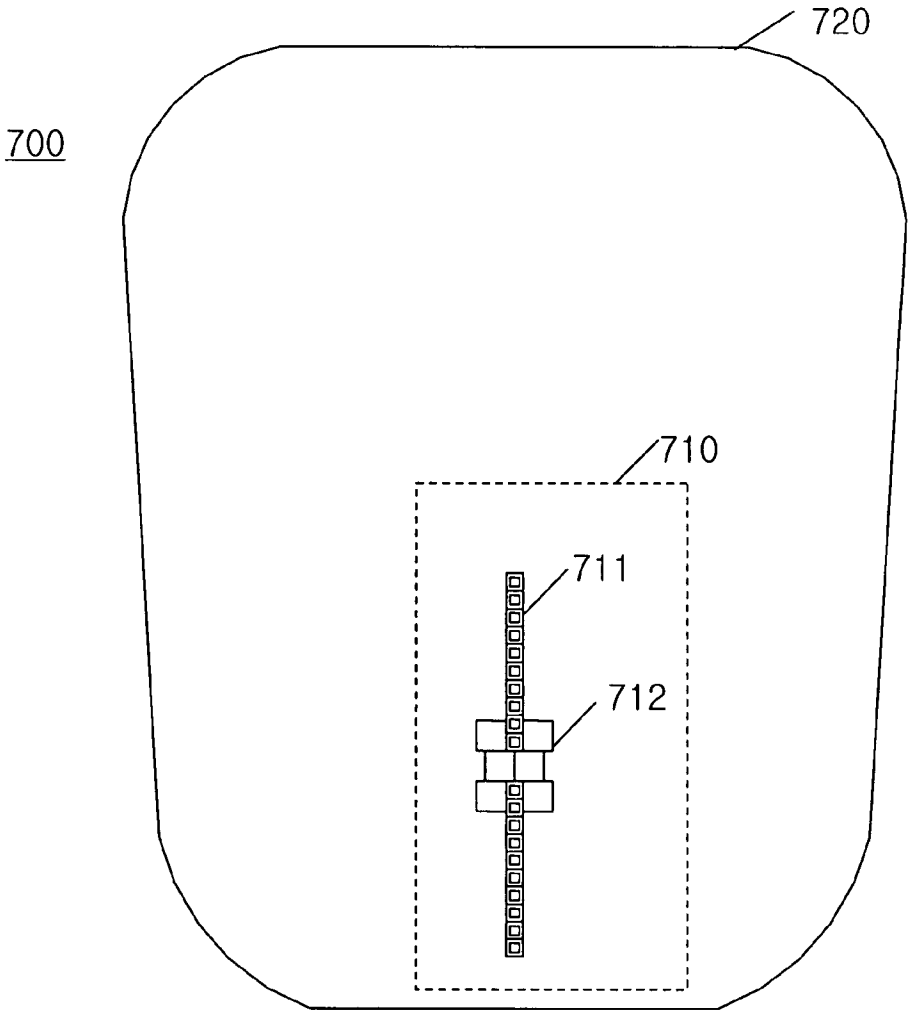
FIG. 7 is a top view of triple-band offset hybrid antenna with a shaped reflector in accordance with a second embodiment of the present invention.

FIG. 7 is a top view of triple-band offset hybrid antenna with a shaped reflector in accordance with a second embodiment of the present invention.

As shown in FIG. 7, the triple-band offset hybrid antenna 700 includes a shaped reflector 720 and a triple-band active phased feed array 710. The triple-band offset hybrid antenna 700 has exactly same structure comparing to the triple-band offset hybrid antenna 100 of the present invention excepting a triple-band active phased feed array 710. Accordingly, detailed explanation of the shaped reflector 720 including the fixing unit 120 and the rotation unit 110 is omitted excepting the triple-band active phased feed array 710.

The triple-band active phased feed array 710 includes Ka/K bands feed array 711 for transceiving Ka/K bands RF signal and a Ku band feed array 712 for receiving a Ku band RF signal.

As shown in FIG. 7, the triple-band active phased feed array 710 is arranged on a focal line where the signal reflected from the shaped reflector 720 is concentrated. The Ka/K bands feed array 711 includes a plurality of Ka/K bands feed array elements which are linearly arranged on the focal line. In the second embodiment of the present invention in FIG. 7, 20 Ka/K bands single feed array elements are linearly arranged on the focal line with the element spacing of 9.4 mm between array elements. It corresponds to 0.96 $\lambda_0$ in Ka band ($f_0$=30.485 GHz) and 0.65 $\lambda_0$ in K band ($f_0$=20.755 GHz), respectively.

The Ku band feed array 712 includes a plurality of Ku band feed array elements which are arranged at right and left sides of the Ka/K bands feed array 112A and at the middle of the Ka/K bands feed array 711. In the second embodiment of the present invention in FIG. 7, 3 Ku band feed array elements are linearly arranged at right side of the Ka/K band feed array 711 and 3 other Ku band single feed array elements are linearly arranged at left side of the Ka/K band feed array 711 with the element spacing of 15 mm between Ku band feed array elements. It corresponds to is 0.59 $\lambda_0$ in Ku band ($f_0$=11.85 GHz). A desired beam direction to satellite for Ka/K bands signal can be easily found by comparing two signal levels received from Ku band feed array elements positioned at both sides of the Ka/K bands feed array 112A.

Figure 8A:
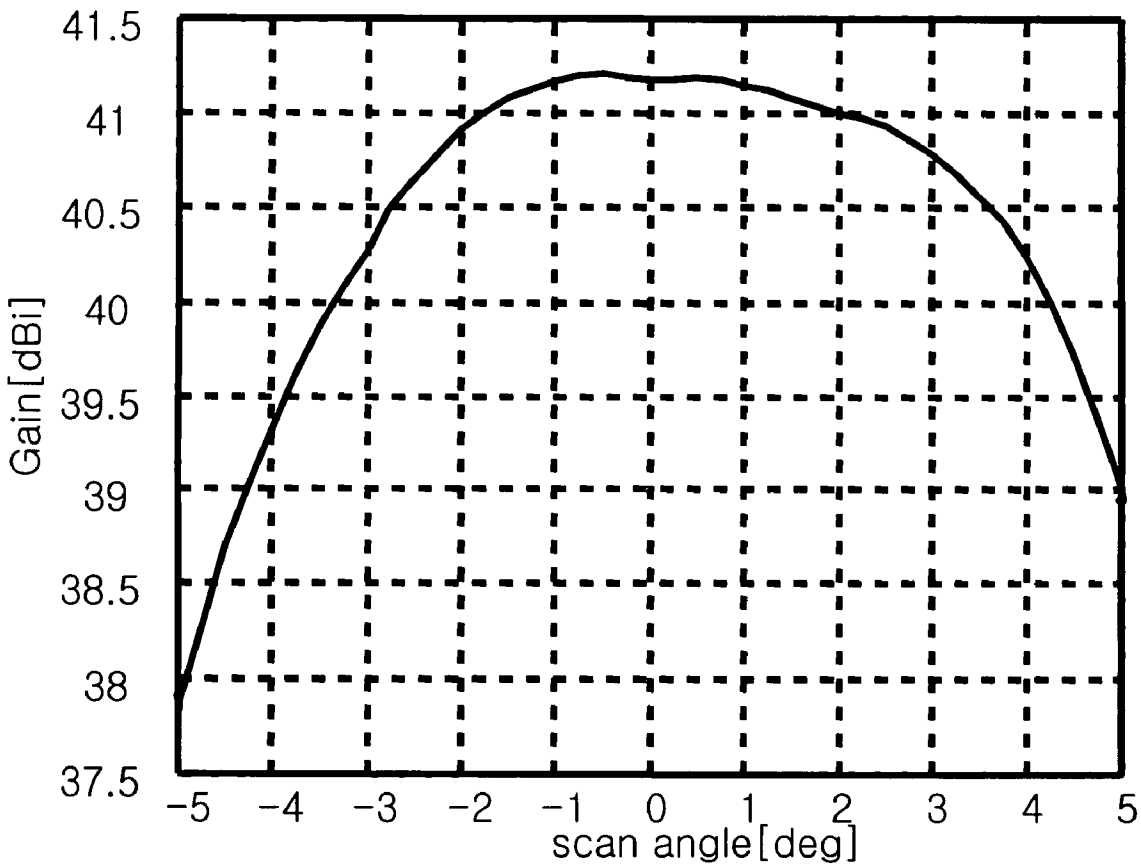
FIGS. 8A and 8B are graphs showing Ka/K band beam scan gain characteristics of the triple-band offset hybrid antenna 700 of the second embodiment in FIG. 7.
Figure 8B:
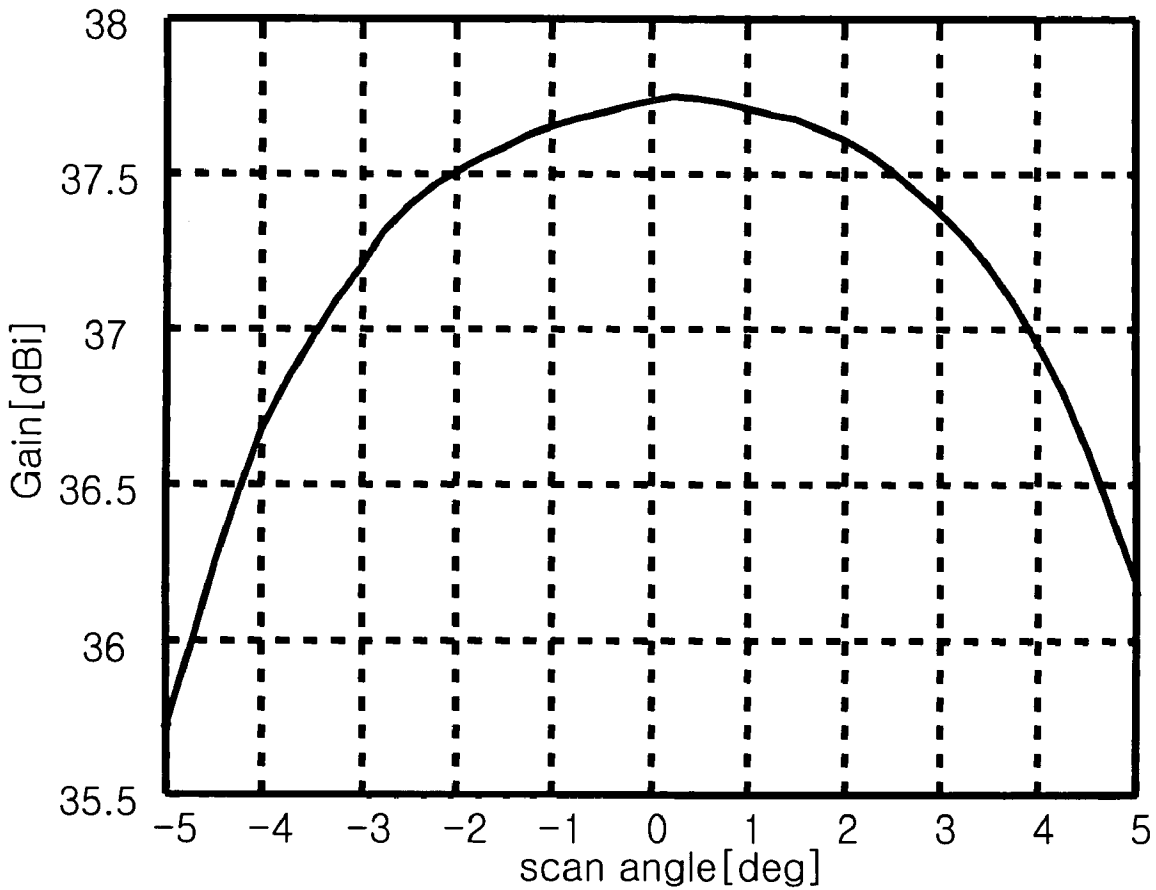
Figure 9A:
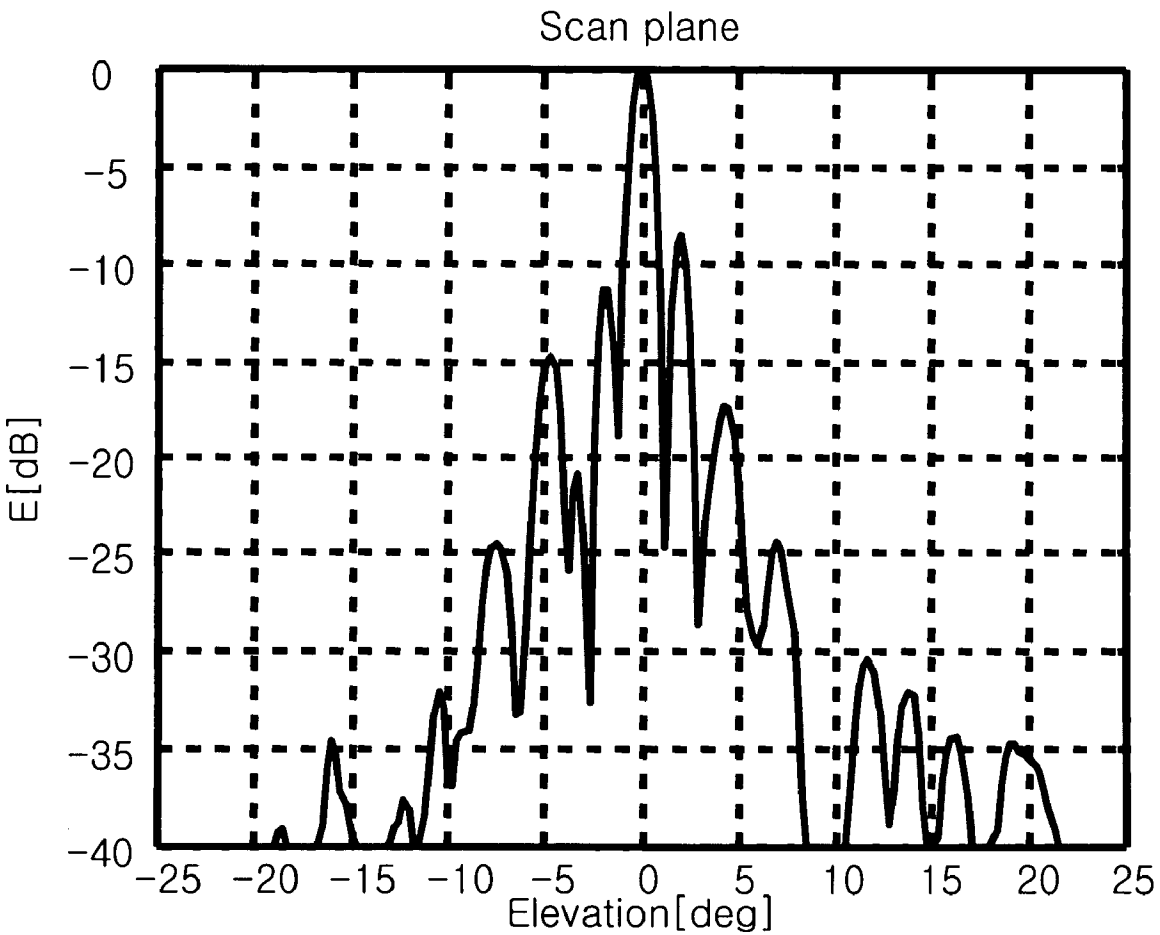
FIGS. 9A to 9D are graphs showing radiation patterns by beam scanning in Ka/K bands of a triple-band offset hybrid antenna 700 in FIG. 7.
Figure 9B:
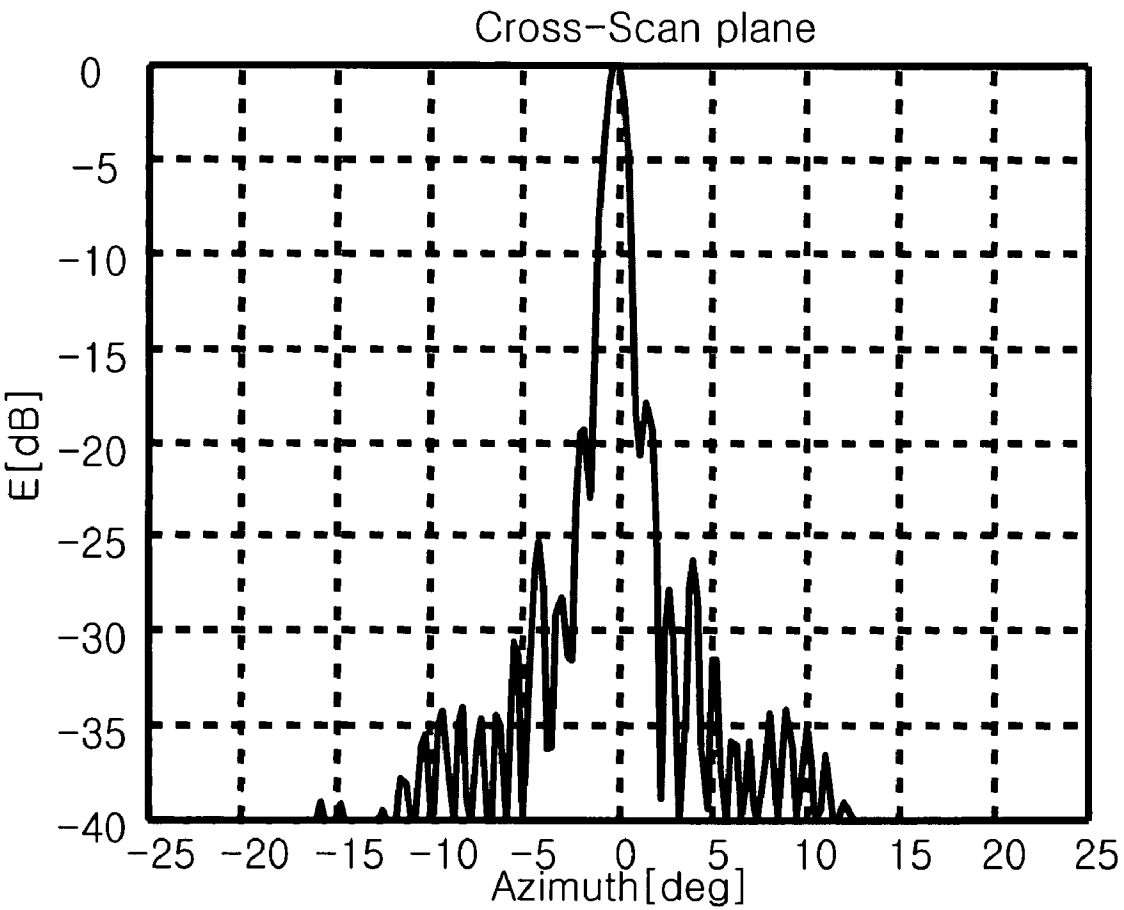
Figure 9C:
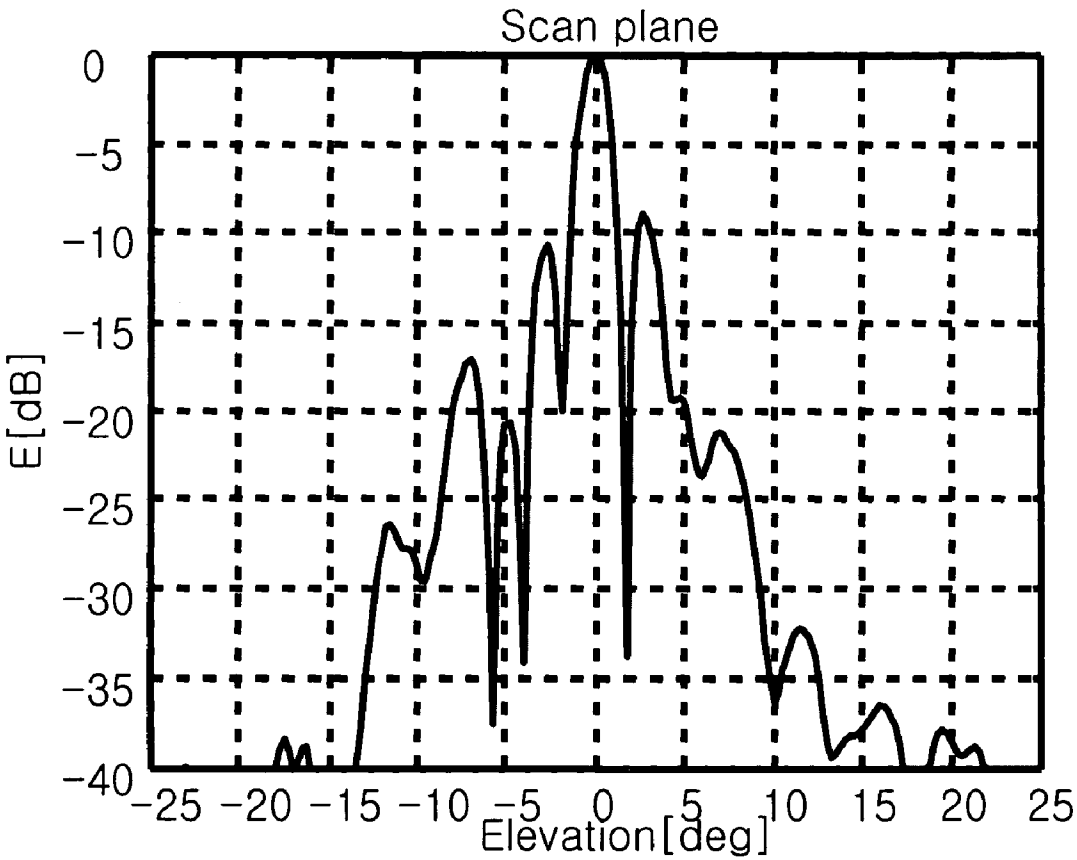
Figure 9D:
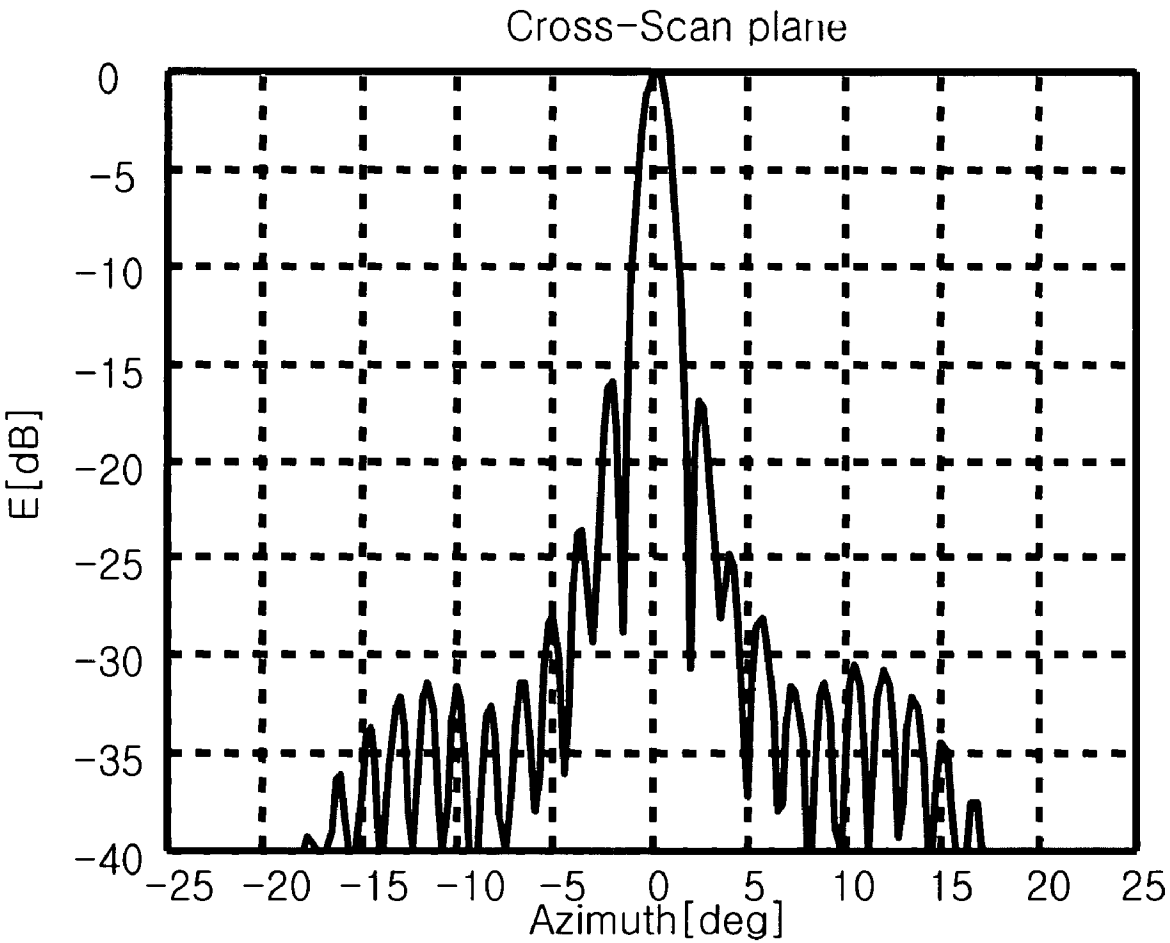

FIGS. 8A and 8B are graphs showing Ka/K band beam scan gain characteristics of the triple-band offset hybrid antenna 700 of the second embodiment in FIG. 7.

As shown in FIG. 8A, the triple-band offset hybrid antenna 700 of the second embodiment provides the gain performance of minimum 40.4 dBi and maximum 41.2 dBi within ±3° of beam scanning range in Ka band.

AS shown in FIG. 8B, the triple-band offset hybrid antenna 700 of the second embodiment provides the gain performance of minimum 37.3 dBi and maximum 37.8 dBi in K band.

FIGS. 9A to 9D are graphs showing radiation patterns by beam scanning in Ka/K bands of a triple-band offset hybrid antenna 700 in FIG. 7.

Figure 10A:
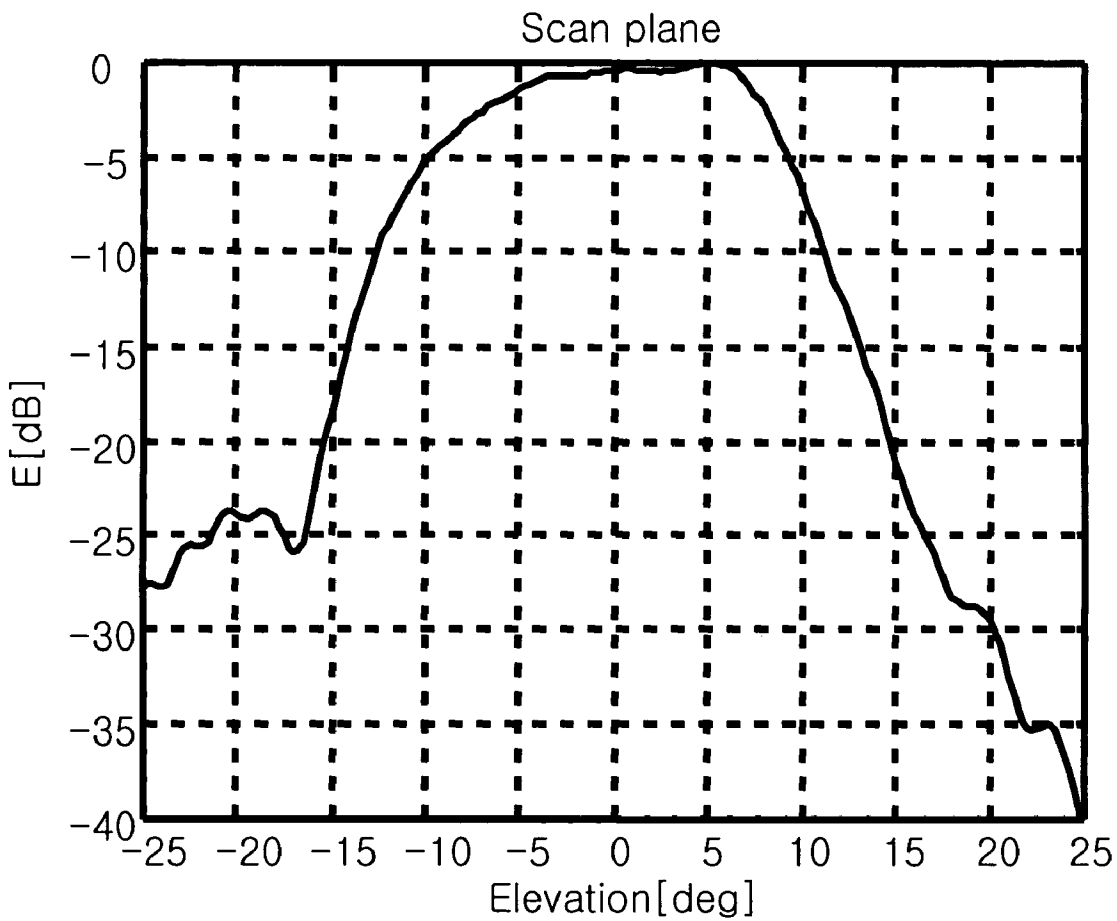
FIGS. 10A to 10B are graphs showing radiation patterns by beam scanning in Ku band of the triple-band offset hybrid antenna 700 in FIG. 7.
Figure 10B:
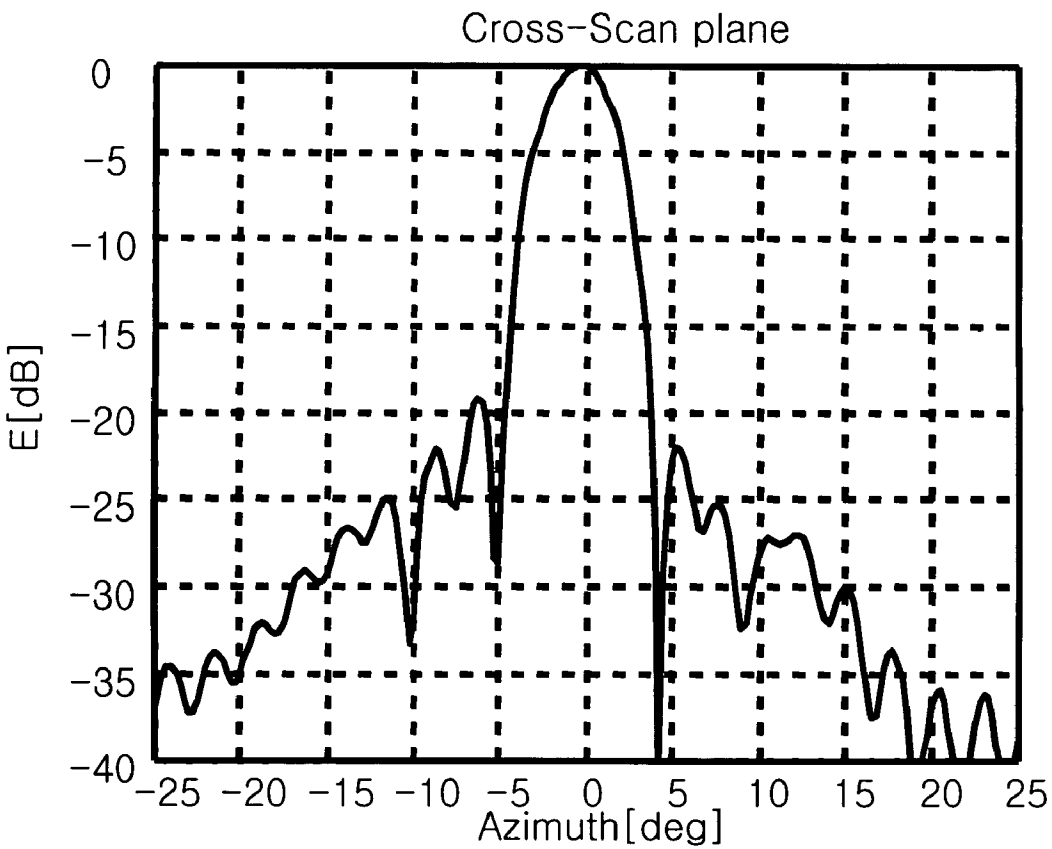

FIGS. 10A to 10B are graphs showing radiation patterns by beam scanning in Ku band of the triple-band offset hybrid antenna 700 in FIG. 7.

As shown in FIGS. 10A to 10B, the triple-band offset hybrid antenna 700 provides the gain performance of minimum 24.5 dBi in Ku band.

Figure 11:
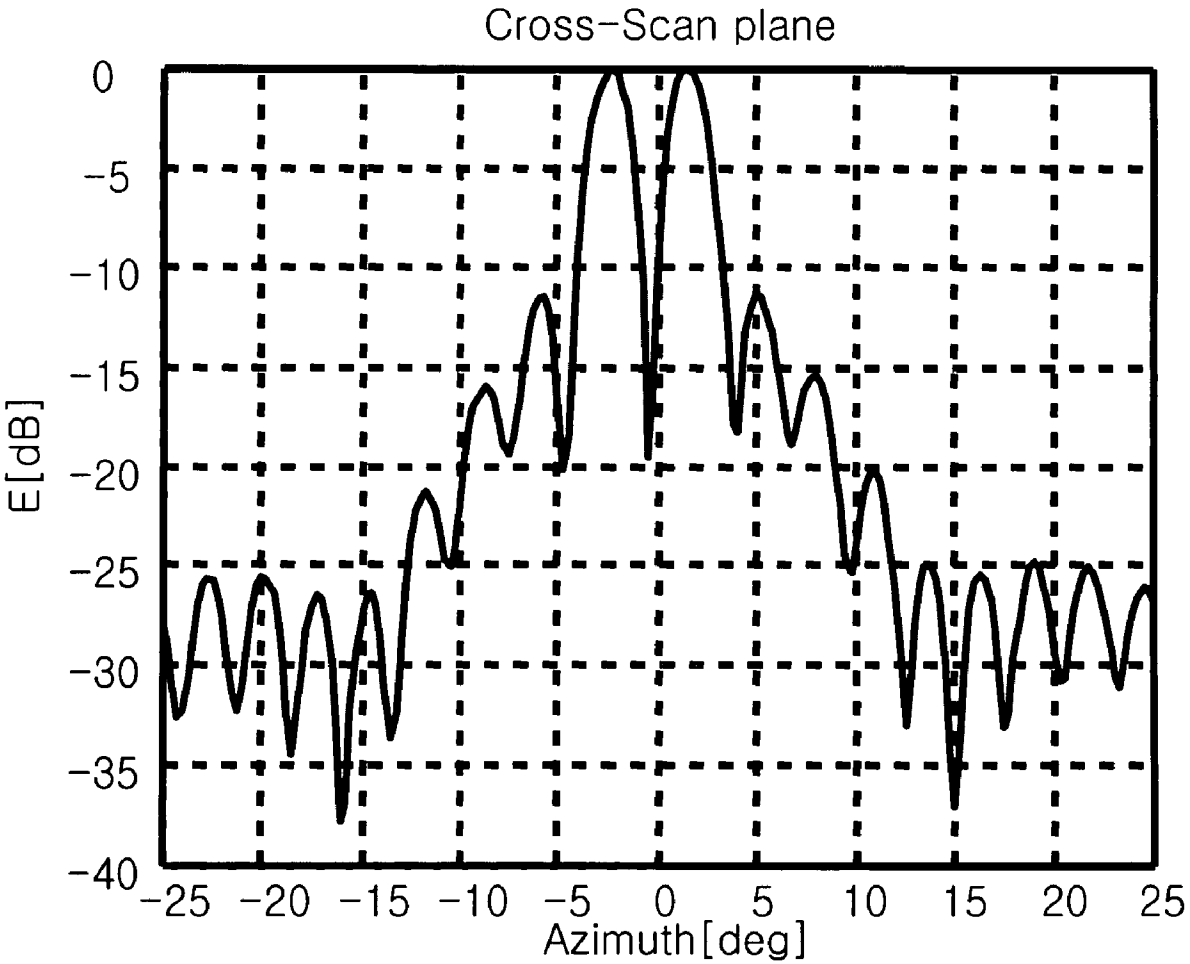
FIG. 11 is a graph showing difference pattern for tracking a satellite in Ku band in accordance with the triple-band offset hybrid antenna 700 in FIG. 7.

FIG. 11 is a graph showing difference pattern for tracking a satellite in Ku band in accordance with the triple-band offset hybrid antenna 700 in FIG. 7.

Both of the triple-band offset hybrid antenna with shaped reflectors 100 and 700 have superior performance as shown in below table 1.

TABLE 1

| | First embodiment 100 | Second embodiment 700 |
|---|---|---|
| Size of shaped reflector | 60 cm × 64 cm | 60 cm × 64 cm |
| Size of Ku band feed array | 16 × 16 mm | 16 × 16 mm |
| Size of K/Ka band feed array | 9.4 × 9.4 mm | 9.4 × 9.4 mm |
| Ka band gain | 40.7 dBi Min | 40.4 dBi Min |
| K band gain | 37.6 dBi Min | 37.3 dBi Min |
| Ku band gain | 24.4 dBi Min | 24.5 dBi Min |

As shown in Table. 1, the K/Ka/Ku bands triple-band offset hybrid antennas with shaped reflectors 100 and 700 satisfy requirements for international antenna side lobe regulation.

As mentioned above, the triple-band offset hybrid antenna with a shaped reflector of the present invention can reduce a blocking loss by offsetting a feed array from the shaped reflector and optimize a beam pattern by shaping an aperture of a reflector.

Also, the triple-band offset hybrid antenna using a shaped reflector of the present invention can be operated in three frequency bands K, Ka and Ku by linearly arranging the K/Ka/Ku bands array elements on the focal line of the shaped reflector.

Furthermore, the present invention can provide a triple-band offset hybrid antenna with relatively high efficiency by removing non-efficient edge areas of a shaped reflector.

Moreover, the present invention can effectively provides a proper direction for a satellite tracking by comparing to two beams from Ku band feed array elements arranged at both sides of the K/Ka bands feed array.

The present application contains subject matter related to Korean patent-application No. KR 2003-0093207, filed in the Korean patent office on Dec. 18, 2003, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A triple-band offset hybrid antenna, comprising:

a shaped reflector reflecting K/Ku bands RF signals received from a satellite to focus an energy of the K/Ku bands RF signals on a focal line and reflecting a Ka band RF transmitting signal; and a triple-band active phased feed array receiving the reflected K/Ku bands RF signals from the shaped reflector and radiating the Ka band RF transmitting signal to the shaped reflector, wherein the triple-band active phased feed array including a Ka/K band feed array for transceiving a Ka/K bands RF signal and a Ku band feed array for receiving a Ku band RF signal, the Ku band feed array including a plurality of Ku band feed array elements symmetrically arranged at opposing sides of the Ka/K band feed array, wherein Ka/K bands feed array includes a plurality of Ka/K bands feed array elements which are linearly arranged on the focal line and the Ku band feed array includes a plurality of Ku band feed array elements which are linearly arranged at a right side and a left side of the Ka/K bands feed array.

2. The triple-band offset hybrid antenna of the claim 1 wherein 23 Ka/K bands feed array elements are linearly arranged on the focal line with the element spacing of 9.4 mm between Ka/K bands feed array elements, which corresponds to 0.96 $\lambda_0$ in Ka band ($f_0$=30.485 GHz) and 0.65 $\lambda_0$ in K band ($f_0$=20.755 GHz), respectively.

3. The triple-band offset hybrid antenna of the claim 1 wherein 5 Ku band feed array elements are linearly arranged at the right side of the Ka/K bands feed array and 5 other Ku band feed array elements are linearly arranged at the left side of Ka/K bands feed array with the element spacing of 15 mm between Ku band feed array elements, which corresponds to 0.59 $\lambda_0$ in Ku band ($f_0$=11.85 GHz).

4. The triple-band offset hybrid antenna of the claim 1 wherein 20 Ka/K bands feed array elements are linearly arranged on the focal line with the element spacing of 9.4 mm between Ka/K bands feed array elements, which corresponds to 0.96 $\lambda_0$ in Ka band ($f_0$=30.485 GHz) and 0.65 $\lambda_0$ in K band ($f_0$=20.755 GHz), respectively.

5. The triple-band offset hybrid antenna of the claims 2 wherein 3 Ku band feed array elements are linearly arranged at the right side of Ka/K bands feed array and 3 other Ku band feed array elements are linearly arranged at left side of Ka/K bands feed array with the element spacing of 15 mm between Ku band feed array elements, which corresponds to 0.59 $\lambda_0$ in Ku band ($f_0$=11.85 GHz).

6. The triple-band offset hybrid antenna of claim 1, wherein the shaped reflector for one-dimensional beam scanning in elevation has a curvilinear rim structure to remove non-efficient areas of surface edge.

7. The triple-band offset hybrid antenna of claim 1 wherein the triple-band active phased feed array is offset from the shaped reflector.

* * * * *